United States Patent [19]

Coyner et al.

[11] Patent Number: 5,073,844

[45] Date of Patent: Dec. 17, 1991

[54] LIGHTED BAGGAGE PIECE

[75] Inventors: Sherri A. Coyner; Donna L. Landers, both of Indianapolis, Ind.

[73] Assignee: The AnnLouise Partnership, Indianapolis, Ind.

[21] Appl. No.: 639,984

[22] Filed: Jan. 11, 1991

[51] Int. Cl.[5] ..... A45C 15/6

[52] U.S. Cl. ..... 362/156; 362/252

[58] Field of Search ..... 362/156, 154, 252, 320, 362/221, 155, 227

[56] References Cited

U.S. PATENT DOCUMENTS

| | | | |
|---|---|---|---|
| D. 293,737 | 1/1988 | Jones | D3/43 |
| D. 298,658 | 11/1988 | Roberts | D26/37 |
| 1,268,846 | 6/1918 | Holton . | |
| 2,218,396 | 10/1940 | Hallbauer . | |
| 2,262,011 | 11/1941 | Kunkel . | |
| 2,558,606 | 6/1951 | Crockett . | |
| 2,565,895 | 8/1951 | Wadland . | |
| 3,307,027 | 2/1967 | Lins et al. . | |
| 3,609,341 | 9/1971 | Castaldo | 240/6.45 P |
| 3,792,652 | 2/1974 | Zeeb | 240/6.45 P |
| 3,808,416 | 4/1974 | Pottratz | 362/156 |
| 4,015,112 | 3/1977 | Castaldo | 240/6.45 P |
| 4,143,411 | 6/1979 | Roberts | 362/145 |
| 4,272,438 | 5/1988 | King | 362/156 |
| 4,376,935 | 3/1983 | Castaldo | 340/571 |
| 4,376,966 | 3/1983 | Tieszen | 362/249 |
| 4,665,470 | 5/1987 | George, Jr. | 362/806 |
| 4,972,304 | 11/1990 | Ylla | 362/156 |

*Primary Examiner*—Ira S. Lazarus
*Assistant Examiner*—Leonard Heyman
*Attorney, Agent, or Firm*—Ice Miller Donadio & Ryan

[57] ABSTRACT

A lighted baggage piece includes a shell having an exterior surface and an interior liner comprising an interior surface. The interior surface includes opposed front and rear walls, with the front and rear walls defining an opening for permitting access to the interior of the baggage piece. The interior surface also includes an opposied first side wall and second side wall, and a bottom wall extending between the first and second side walls. A power source, such as a battery is provided along with a first pouch disposed on the front wall for holding the battery. A switch is operatively coupled to the battery. A second pouch is disposed on the rear wall adjacent the opening for holding the switch. The string of lights encased in generally transparent flexible, tubular, plastic shield extend along a portion of each of the first side wall, bottom wall and second side wall. A string of lights are operatively coupled to the battery and switch, and are positioned to illuminate the interior of the baggage piece.

9 Claims, 3 Drawing Sheets

LIGHTED BAGGAGE PIECE

TECHNICAL FIELD OF THE INVENTION

The present invention relates to baggage pieces, and more particularly to a baggage pieces having a lighting system for lighting the interior thereof.

BACKGROUND OF THE INVENTION

Baggage pieces come in a large variety of shapes, sizes and descriptions for serving a wide variety of purposes. Examples of such baggage pieces include suitcases, briefcases, suit carriers, cosmetic cases and purses. A typical baggage piece, such as a purse, includes a shell having an exterior, and an interior into which items such as clothes, makeup compacts, wallets, writing instruments, and documents can be placed. An opening is provided to enable the user to obtain access to the interior of the purse. A closure element such as a clamp, clasp or zipper is provided to selectively seal and unseal the opening. A handle or strap is also provided to enable the user to better carry the purse or baggage piece.

One difficulty faced by the users of baggage pieces in general, and purses in particular, is finding items in the interior of the purse. For many purses, the openings are not sufficiently large to enable a great deal of light to enter the interior of the purse. Thus, even when the opening of the purse is unsealed, the light traveling into the interior of the purse is usually insufficient to illuminate all of the items inside the purse. Especially difficult to illuminate are items placed at or close to the bottom of the interior of the purse such bottom dwelling items are often covered by other items resting on top of them. As will be appreciated, finding these bottom dwelling items, requires the user to open the purse and fish through its contents until the desired item is found. Often, this desired item is found not by the user sighting the item, but rather by the user fishing around until she feels the desired item.

To alleviate this difficulty encountered by purse users, several devices have been invented that incorporate a light source into the interior of the purse.

Holton, U.S. Pat. No. 1,268,846 discloses a purse wherein a battery provides energy for a single light bulb. The light is actuated by a switch having a contact plate which causes the bulb to be illuminated when the purse is opened. Lins, U.S. Pat. No. 3,307,027 is similar to Holton in that it relates to a purse having a switch plate for turning the light on and off when the purse is opened and closed.

Hallbauer, U.S. Pat. No. 2,218,396 relates to a purse having a battery powered light. Crockett, U.S. Pat. No. 2,558,606 relates to a battery powered purse light wherein the light is movably mounted in the purse to enable the user to focus the light on various portions of the purse.

Kunkel et al., U.S. Pat. No. 2,262,011 discloses a light that is mounted in a purse. The light is turned on and off through the actuation of a switch. Waublind, U.S. Pat. No. 2,565,895 relates to a purse that is opened and closed through the action of a zipper. The zipper includes a tongue that makes contact with a switch to automatically turn the light in the purse on and off when the zipper is opened and closed respectively.

Castaldo, U.S. Pat. No. 3,609,341 relates to a purse having a turnable buckle. The light is turned on and off when the turnable buckle is rotated. Castaldo, U.S. Pat. No. 4,015,112 relates to a turnable buckle that can be used in connection with the turnable buckle purse shown in the Castaldo 3,609,341 patent.

Zeeb, U.S. Pat. No. 3,792,652 relates to a purse having a thumb switch. Actuation of the thumb switch turns the light in the purse on and off.

Roberts, U.S. Pat. No. 4,143,411 relates to a lighting apparatus for use in architectural settings. Roberts lighting elements consists of a clear tube containing a selected plurality of low wattage light bulbs used in combination with a retaining structure which adapted for captive retention within a molded cementitious structure.

Costaldo, U.S. Pat. No. 4,376,935 relates to a purse that includes both an audible alarm and a light. A magnetic switch arrangement is provided to actuate either or both of the alarm and light when the purse is opened and closed.

King, U.S. Pat. No. 4,742,438 relates to a light housing for use in purses. King's device includes a two-part light mechanism with the first part being a mounting bracket, and the second part being the light/battery housing. In the practice of King's invention, one would purchase several mounting brackets. A mounting bracket would be placed in each purse owned by the user. The light housing is then connectable to any of the mounting brackets and can be transferred by the user from purse to purse.

Roberts, et al., U.S. Design Patent No. 298,658 relates to an ornamental design for a portable flashlight that can be used as a purse illuminator. Jones, U.S. Design Patent No. 293,737 relates to a lighted compact/purse.

Although many of the references discussed above do disclose the concept of providing a lighting system for a baggage piece or purse, room for improvement exists. One area in which this room for improvement exists is in the area of providing a lighting system that more fully illiminates the entire interior volume of the purse, including the bottom and sides of the purse.

Therefore, it is one object of the present invention to provide a lighting system for a purse that provides illumination not only to the upper regions of the purse, but also to the bottom and side portions of the interior of the purse.

SUMMARY OF THE INVENTION

A lighted baggage member is provided that comprises a shell having an exterior surface and an interior surface. A power source means and a switch means are also provided. The switch means is operatively coupled to the power source means. A plurality of lights are coupled in series and disposed along the interior surface of the shell. Lights are operatively coupled to the power source means and the switch means.

Preferably, the plurality of lights comprises string of "tivoli", lights that are encased in a generally transparent, flexible tubular plastic shield. The string of tivoli lights extends along a portion of each of the first side wall, bottom wall, and second side wall.

Additionally, a first pouch means is provided on the first side wall for holding the power source means, and a second pouch means is provided on the second side wall for holding the switch means. Preferably, the second pouch means is located adjacent to the opening of the purse for permitting easy actuation of the switch means by the user.

One feature of the present invention is that the light source for the baggage piece comprises a string of lights containing a plurality of light sources. This feature has the advantage of placing light sources at a variety of positions within the purse, thus more completely illuminating the interior of the purse. Further, this plurality of light sources reduces the number of "dark spots" caused by shadows cast by objects within the purse.

Another feature of the present invention is that the string of lights are positioned along the sides and bottom of the purse. This feature has the advantage of better illuminating the entire interior of the purse, including those darker recesses of the purse near its bottom that are most likely not to be illuminated by existing room light when the purse is opened.

A third feature of the present invention is that the flexible lighting system employs a string of lights encased in a protecting flexible tubular shield. This feature has several advantages. The flexible nature of the tubular shield enables the shield to better conform to the interior surface of the purse, and better adapts the lighting system for use with "soft shell" purses. Another advantage obtained by the protecting tubular shield is that the potentially breakable bulbs are protected from being broken by objects within the purse.

It is also a feature of the present invention that a coupling means is provided for coupling the tubular shield to the interior of the purse. The coupling is configured to removably receive the shield. This feature has the advantage of facilitating the replacement of the light string if one or more of the bulbs within the light string burns out or becomes broken. The light string can be replaced without forcing the user to discard the purse shell.

Additional features and advantages of the invention will become apparent to those skilled in the art upon consideration of the following detailed description of a preferred embodiment exemplifying the best mode of carrying out the invention as perceived presently. The detailed description particularly refers to the accompanying figures in which:

DETAILED DESCRIPTION OF INVENTION

Figure 1:
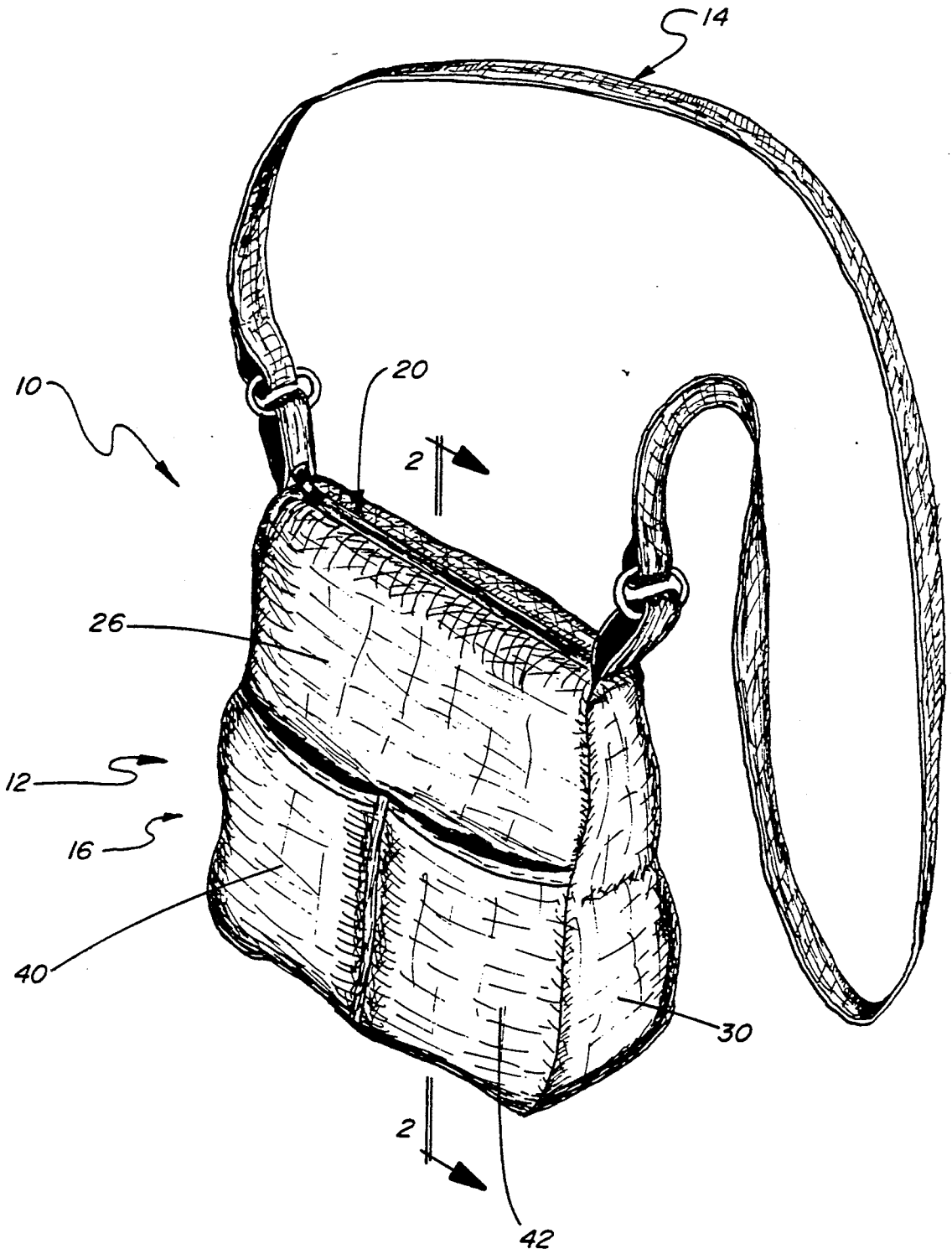
FIG. 1 is a perspective view of the lighted purse of the present invention.
Figure 2:
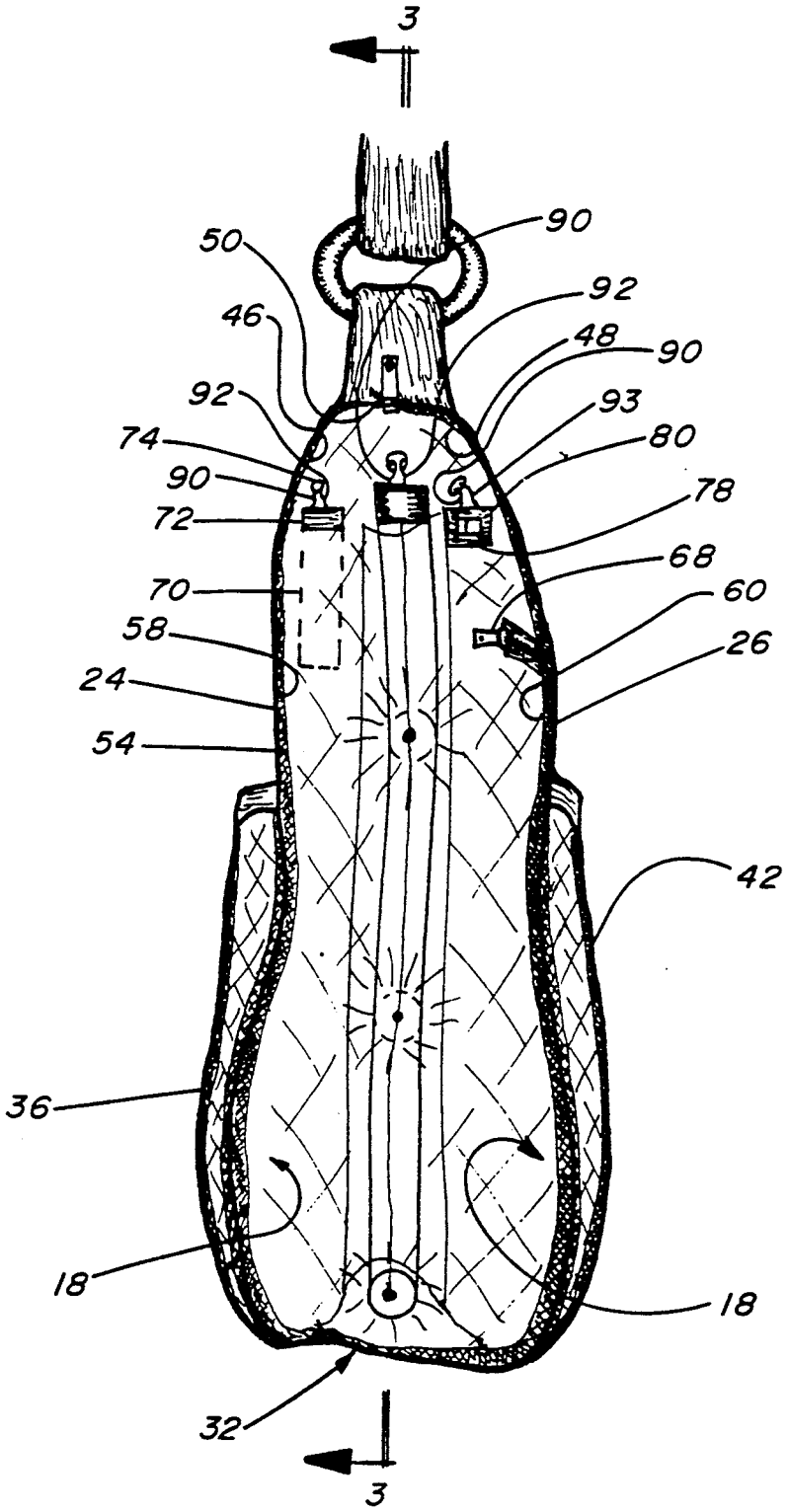
FIG. 2 is a sectional view taken along lines 2—2 of FIG. 1.
Figure 4:
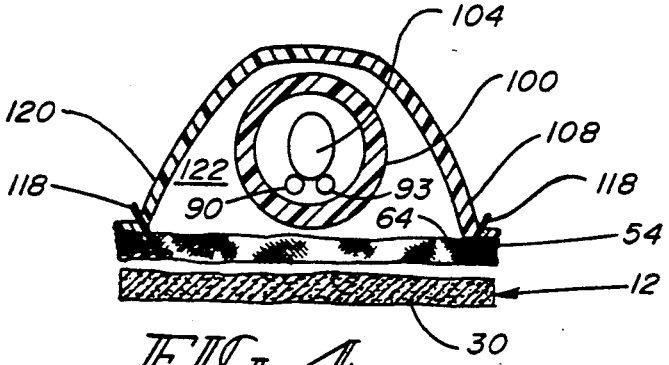
FIG. 4 is an enlarged sectioned view taken along lines 4—4 of FIG. 3.

A baggage piece such as a purse 10 is shown in the drawings as including a shell 12 that comprises the body of the purse 10. A strap 14 that comprises a handle with which the user can carry the shell 12 of the purse 10 is coupled to the shell 12 of the purse 10.

The purse 10 shown in the drawings comprises a "soft-shell" purse of the type wherein the shell consists of a fabric material and does not include any rigid framework members. The soft fabric nature of the shell 12 makes the shell 12 deformable. The strap 14 shown in the drawings, comprises a relatively long (e.g. 35 inches, (91.44 cm.)) "over the shoulder" strap 14. It will be appreciated that the shell 12 and strap 14 configurations shown in the drawings are merely illustrative, and that the shell 12 and strap 14 could assume a wide variety of other configurations consistent with the spirit of the invention.

The shell 12 includes an exterior surface 16 and an interior surface 18. The interior surface 18 defines a cavity that comprises the interior of the shell 12 of the purse 10. An opening 20 is provided to permit the user to gain access to the interior of the purse 10.

The exterior surface 16 of the purse includes a front exterior surface 24, and a rear exterior surface 26. The front and read exterior surfaces 24, 26 are placed in an opposed relation. The exterior surface 16 also includes a first side exterior surface 28 and a second side exterior surface 30, which are placed in an opposed relation. Each of the first and second side exterior surfaces 28, 30 are joined along their edges to each of the front and rear exterior surfaces 24, 26. A bottom exterior surface 32 is also provided to extend along the bottom of the shell 12 of the purse.

A unitary exterior, top-opening pocket 36 is disposed on the front exterior surface 24 of the purse 10. A pair of smaller exterior pockets 42 are disposed on the rear surface 26 of the shell 12. The exterior pockets 42 are also top-opening. Each of the smaller exterior pockets 42 extends approximately half-way across the width of the rear exterior surface 26.

A first interlocking fastener extends across the top edge 46 of the front exterior surface 24, and a second interlocking fastener extends across the top edge 48 of rear exterior surface 26. The pair of interlocking fasteners are joinable to form zipper 50. The interlocking fasteners of zipper 50 define the opening 20 of the shell 12.

The interior surface 18 of the purse 10 is defined by a fabric liner 54 which is placed in an opposed, adjacent relationship to the inner surface of the shell 12. Preferably, the shell 12 is comprised of a leather or vinyl material, and the liner 54 is comprised of a thinner silk, polyester, or cotton fabric material.

The interior surface 18 includes an interior front wall 58, an interior rear wall 60, a first side wall 62, a second side wall 64 and a bottom wall 66. These interior walls 58, 60, 62, 64 and 66 correspond generally in placement and name to their exterior surface counterparts 24, 26, 28, 30, 32. The front and rear interior walls, 58, 60 are placed in an opposed relation, as are the first and second side walls, 62, 64. The edges of the bottom wall 66 are connected to each of the front, rear, first side and second side walls 58, 60, 62, 64 respectively.

A second zipper 68 is coupled to the liner 54 along the rear wall 60 of the purse 10. The second zipper 68 defines an opening to an interior pocket (not shown) which is disposed between the liner 58 and the shell 12.

The liner 54 of the front wall 58 includes a first pouch means 70 formed therein. This first pouch means 70 can be formed by sewing an additional swatch of liner material onto the liner 54. Alternately, the first pouch 70 can be formed between the inner surface of the shell 12 and the liner 54. First pouch means 70 is sized and configured to hold a power source means such as a nine volt DC battery 72. As will be appreciated, the size of the pouch 70 depends largely upon the size of the power source means to be held therein.

Disposed adjacent the first pouch means 70 is a grommet 74 that defines an aperture (not shown) through which wires 90, 92 can pass from the interior of the purse to that portion of the purse 10 between the liner 54 and the shell 12. A plug (not shown) can be provided for coupling the battery 72 to the pair of electrical wires 90, 92 extending therefrom.

The rear interior wall 60 includes a second pouch means 78 formed therein. Second pouch means 78 can be constructed similarly to first pouch means 70, and is sized to hold a user actuable on-off switch 80. The second pouch 78 is a top opening pouch that is disposed adjacent to the opening 20 of the purse, to place the on-off switch 80 adjacent to the opening 20 of the purse 10. By placing the on-off switch 80 adjacent to the opening of the purse 10, the user is better able to actuate the on-off switch 80. A pair of wires 90, 93 extend from the on-off switch 80.

A string of tivoli lights 84 are disposed in the interior of the purse, and extend along substantially all of the length of the first side wall 62, second side wall 64 and bottom wall 66. An example of such a "tivoli lights" string that will perform satisfactorily in the present invention is FLEX LIGHTS brand lights manufactured by Vista Manufacturing Company of Elkhart, Ind.

The string of tivoli lights 84 are operatively coupled to both the nine volt DC battery 72 and the user actuable on-off switch 80 by wires 90, 92, 93. A grommet 94 extends through the liner 54 on the first side wall 62 of the purse 10 so that the wires 90, 92 can extend from the interior of the purse 10 into that space of the purse 10 between the liner 54 and the shell 12. In this way, the wires 90, 93 are not exposed in the interior of the purse 10.

The string of lights 84 includes a transparent tubular plastic shield 100. Shield 100 is sufficiently flexible to enable the string 84 of lights to conform to the curvature of the interior surfaces of the first side wall 62, bottom wall 66 and second side wall 64. The string of lights 84 includes a plurality of low wattage bulbs 104 protectively encased within the shield 100. The bulbs 104 are spaced at regular intervals along the string 84.

A sheet-like, generally transparent flexible coupling member 108 is provided for coupling the string of lights 84 to the interior surfaces of the first side wall 62, bottom wall 66 and second side wall 64. The coupling member 108 preferably comprises an elongated, generally rectangular sheet-like piece of plastic which is sewn along its edges to the liner 54, by thread 118. The coupling member 108 extends from its first end 112 adjacent the first end of the string of lights 84 near the top of the first side wall 62, to its second end 114 which is disposed adjacent to the top of the second side wall 64. By sewing the coupling member to the liner 54 with thread 118 along its side edges 120, the coupling member 108 forms a pocket 122 for slidably receiving the transparent shield 100 of the string of lights 84. Preferably, the pocket 122 thus formed should snugly receive the transparent shield 100.

The coupling member 108 can be sewn to the liner 54 at its first 112 and second 114 ends, to securely maintain the string of lights 84 within the pocket 122. Alternately, one or both of the ends 112, 114 can be left open to facilitate removal of this string of lights 84 from the pocket 122. By enabling the string of lights 84 to be removed, the user can better launder the purse 10, if necessary, or replace the string of lights 84 if one or more of the bulbs 104 burns out.

Figure 3:
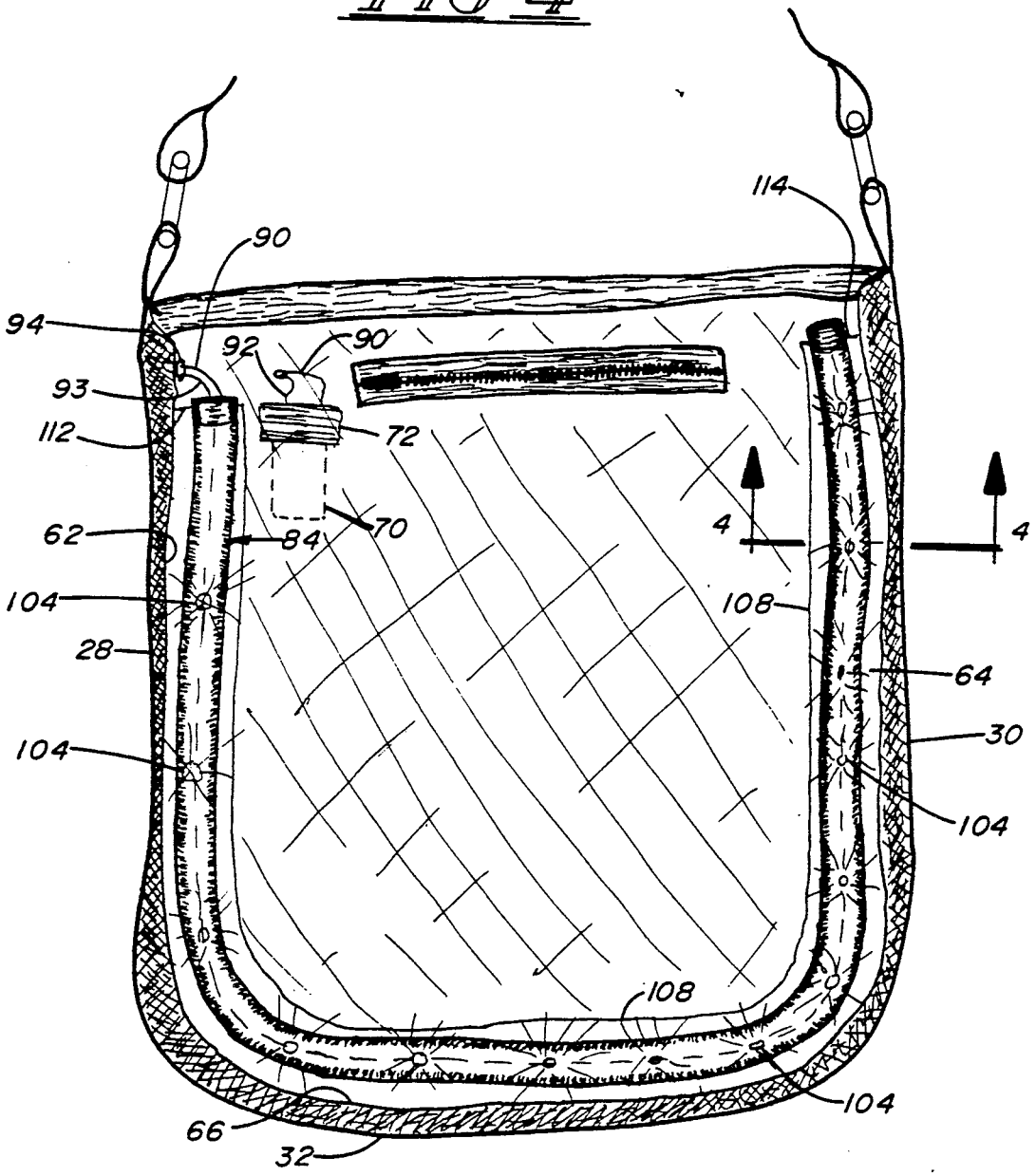
FIG. 3 is a sectional view taken along lines 3—3 of FIG. 2.

Turning now to FIG. 3, it will be noticed that the string of lights having the plurality of individual bulbs 104 provides illumination in the interior of the purse 10 at a variety of locations. The bulbs 104 along the bottom wall 104 are especially helpful in illuminating the lower regions of the purse, to help the user better find keys, lipstick containers and the like that may dwell at the bottom of the purse 10. As will be appreciated, the lower regions of the interior of the purse 10 are often the most difficult in which to find such articles, because articles above the lower regions often block the entrance of ambient light into the lower regions.

Although the invention has been described in detail with reference to certain preferred embodiments and specific examples, variations and modifications exist within the scope and spirit of the invention as described and as defined in the following claims.

What is claimed is:

1. A lighted baggage member comprising (1) a shell having an exterior surface and an interior surface, the interior surface including a first side wall, a bottom wall, and a second side wall, (2) a power source means, (3) a switch means operatively coupled to the power source means, and (4) a string of lights encased in a generally transparent flexible tubular plastic shield, and disposed along the interior surface of the shell, to extend along a portion of each of the first side wall, bottom wall, and second side wall, the lights being operatively coupled to the power source means and the switch means.

2. The invention of claim 1 further comprising a first pouch means for holding the power source means, and a second pouch means for holding the switch means.

3. The invention of claim 2 wherein the purse includes an opening extending between the first and second side walls, and the interior surface includes a front wall extending between the first and second side walls and a rear wall extending between the first and second side walls, the first pouch means being disposed on the front wall adjacent the opening, and the second pouch means being disposed on the rear wall adjacent the opening.

4. The invention of claim 3 wherein the switch means comprises a user actuable on-off switch, and the power source means comprises a nine-volt DC battery.

5. The invention of claim 3 wherein the string of lights comprises a string of tivoli lights.

6. A lighted baggage member comprising (1) a shell having an exterior surface and an interior surface, the interior surface including a first side wall, a bottom wall, and a second side wall, (2) a power source means, (3) a switch means operatively coupled to the power source means, (4) a string of lights encased in a generally transparent, flexible tubular plastic shield, and disposed along the interior surface of the shell, the lights being operatively coupled to the power source means and the switch means, and (5) means for coupling the tubular plastic shield to the bottom wall, first side wall and second side wall of the interior surface.

7. A lighted purse comprising:

(1) a shell having an exterior surface, and an interior liner comprising an interior surface, the interior surface including an opposed front and a real wall, the front and rear walls defining an opening for permitting access to the interior liner, an opposed first side wall and second side wall, and a bottom wall extending between the first and second side walls, (2) a power source means (3) a first pouch means disposed on the front wall for holding the power source means, (4) a switch means operatively coupled to the power source means, (5) a second pouch means disposed on the rear wall adjacent the opening for holding the switch means, and (6) a string of lights encased in a generally transparent flexible, tubular, plastic shield extending along a portion of each of the first side wall, bottom wall and second side wall, the string of lights being operatively coupled to the power source means and switch means.

8. The invention of claim 7 wherein the switch means comprises a user actuable on-off switch means, and the power source means comprises a nine-volt DC battery.

9. The invention of claim 7 further comprising coupling means for coupling the tubular plastic shield to the first side wall, second side wall and bottom wall, the coupling means comprising an elongated flexible, generally planar coupling member having first and second side edges sewn to first side wall, second side wall and bottom wall for forming and elongated pocket for removably receiving the tubular shield.

* * * * *